US005222618A

United States Patent [19]

Koch

[11] Patent Number: 5,222,618

[45] Date of Patent: Jun. 29, 1993

[54] RECTANGULAR CONTAINER FOR FLUID OR SEMIFLUID PRODUCTS

[75] Inventor: Frederick C. Koch, Barcelona, Spain

[73] Assignee: Gian Luigi Apointe, Barcelona, Spain

[21] Appl. No.: 740,468

[22] Filed: Aug. 5, 1991

[30] Foreign Application Priority Data

Aug. 7, 1990 [ES] Spain ..... 9002131

[51] Int. Cl.[5] ..... B65D 88/00

[52] U.S. Cl. ..... 220/1.5; 220/647; 220/653

[58] Field of Search ..... 220/646, 647, 651, 652, 220/653, 1.5

[56] References Cited

U.S. PATENT DOCUMENTS

| | | | |
|---|---|---|---|
| 1,005,933 | 10/1911 | Brown | 220/653 |
| 1,268,883 | 6/1918 | Knox | 220/608 |
| 1,443,500 | 1/1923 | Phillips | 220/653 |
| 3,062,402 | 11/1929 | Farrell et al. . | |
| 3,124,265 | 3/1964 | Bertels | 220/653 |
| 3,172,560 | 3/1965 | Bergmann | 220/652 |
| 3,563,445 | 2/1971 | Clayton | 220/608 |
| 4,212,405 | 7/1980 | Schmidt | 220/653 |

FOREIGN PATENT DOCUMENTS

| | | | |
|---|---|---|---|
| 0191737 | 8/1986 | European Pat. Off. . | |
| 2027926 | 3/1972 | Fed. Rep. of Germany . | |
| 824075 | 1/1961 | France | 220/651 |
| 2164531 | 3/1973 | France . | |
| 422650 | 4/1967 | Switzerland . | |

*Primary Examiner*—Joseph Man-Fu Moy
*Attorney, Agent, or Firm*—Darby & Darby

[57] ABSTRACT

An improved container for fluid or semifluid materials has a prismatic rectangular shape determined by partition walls rigidly joined together by means of profiles and ties. The walls forming the top and the base of the container have longitudinal profiles joined alternatively to each other by means of resistant ties, defining a triangular structural framework reinforcing the structure of the container to prevent deformation or bulging thereof by internal pressure. In the preferred embodiment, the walls of the container are corrugated transversely. The corrugation of the top and the base walls is formed from over elevations or elongated cavities with rounded ends. The preferred embodiment further has cross-braces emerging from the top corners of the containers to define bending preventive reinforcement of the container.

5 Claims, 3 Drawing Sheets

RECTANGULAR CONTAINER FOR FLUID OR SEMIFLUID PRODUCTS

OBJECT OF THE INVENTION

The present invention elates to improvements in the construction of containers, of a taupe used to transport fluid products such as liquids, semi-fluid or annular products such as sand, feed, ground or powdered materials, seeds and grains, etc., or for products that can be solidified such as asphalt, tar, bitumen, etc.

BACKGROUND OF THE INVENTION

Containers used to transport products such as those listed above are designed with a spherical or cylindrical shape, so that the pressures created by the products are distributed relatively uniformly. In the case of spherical containers, the stresses to be supported by the walls of the container are perfectly uniform.

However, the construction of of a spherical vessel is not simple, aside from the inconvenience that spherical shapes have, where the volumetric capacity is very reduced in terms of the outer occupied space.

In the case of cylindric tanks, though the construction the tank or container is enormously simplified, there is again the inconvenience of inadequate use of space, since the transversal section remains circular and therefore the volumetric capacity is likewise reduced in terms of the outer space occupied by the container.

SUMMARY OF THE INVENTION

The improvements of the invention, applicable to containers for products like the ones described above solve the inconveniences that conventional containers have, in such a way that the cost of mating the container, in accordance with these improvements, is reduced approximately to one-sixth the cost to obtain cylindric and spherical containers. The invention also permits obtaining total use o the outer space and allows direct filling of the containers, for example, in holds of a ship.

The invention involves using panels or partition walls, rigidly joined together, forming a general overall rectangular prismatic shape.

The containers itself is constructed by employing flat partition walls that, rigidized together, form a rectangular prismatic body having longitudinal reinforcement cross bars, ties between the longitudinal cross bars, cross braces, etc.

The container according to the invention has a top having an inlet and a base, constituting the longer parts, in such a way that in the inner surface of the partition walls that form the top and base longitudinal profiles are linked together by means of resistant ties that make the container resistant enough to endure a relative inner pressure, and hence, are locked together.

The partition walls that form the walls of the container itself, including the top and bottom bases are transversely corrugated, the corrugation being formed in said top and base by means of over-elevations or else by elongated cavities with rounded ends.

The resistant ties joining the longitudinal profiles are connected alternatively to those profiles forming a triangular framework suitable to endure internal pressures, thereby preventing the partition walls that form the top and bottom bases from bulging outward. If, because of the size of the container or because it is used to contain very dense products, or because the pressure of the load itself, the outer ties of each section can be connected to intermediate points of the side partition walls, in which case they will also include the respective longitudinal profile.

Finally, the container includes cross braces that reinforce the entire structure to prevent the possible longitudinal bending of the container when resting on the ends or when it is raised by the corners.

In order to complement the description that is going to be made hereinafter and for the purpose of providing a better understanding of the features of the invention, the present specification is accompanies by a set of drawings by which the innovations and advantages of the invention will be more easily understood.

DESCRIPTION OF THE PREFERRED EMBODIMENT

In view of these figures one can see how the container made in accordance with the invention, has a rectangular prismatic shape, obtained by means of the rigidized fastening among size flat partition walls (1) that form the respective surfaces of the rectangular prism itself, the partition walls (1) joining the contiguous ones.

Figure 1:
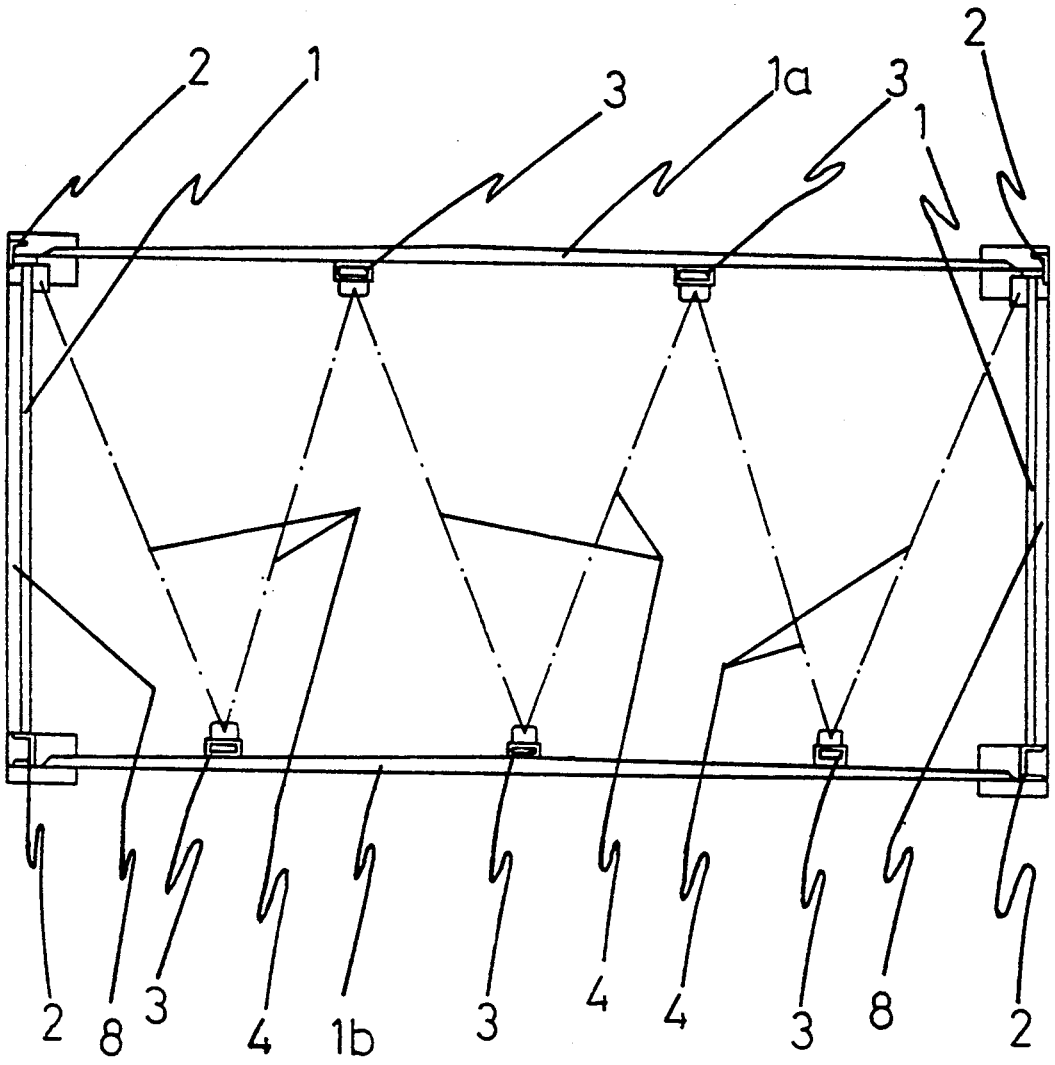
FIG. 1 shows a schematic sectional view of the container corresponding to a raised view of one of the smaller surfaces.
Figure 2:
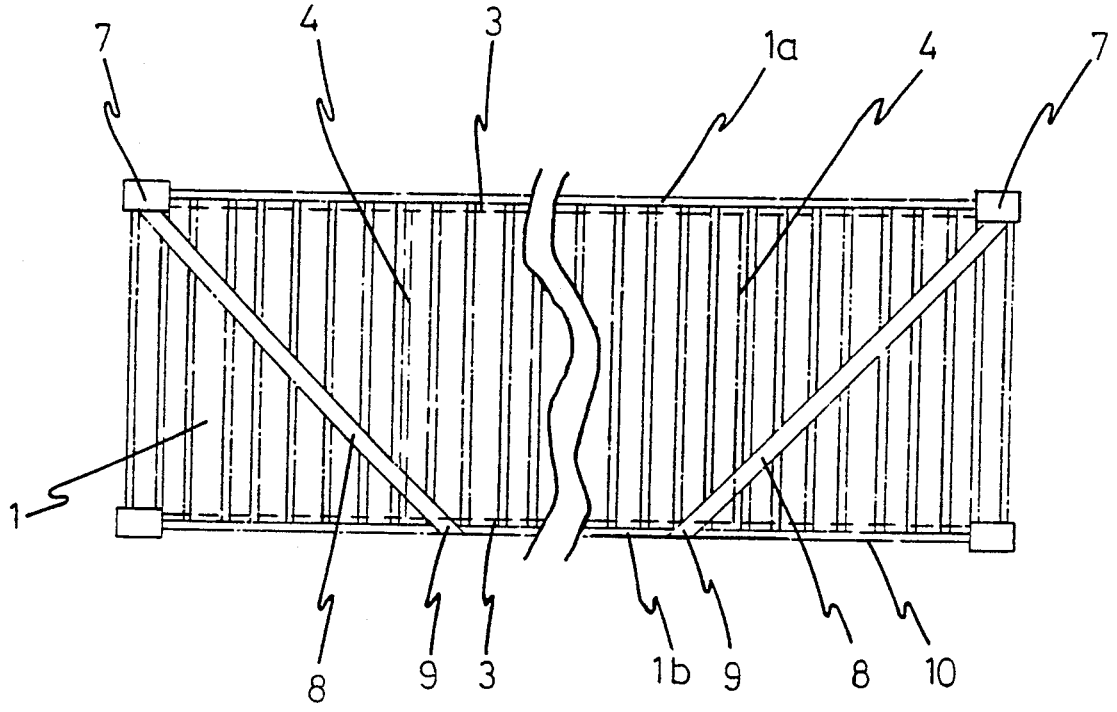
FIG. 2 shows a raised outer side view of the container itself in correspondence within one of the larger surfaces.

The top and base of the container are formed by profiles (1*a*) and (1*b*), the partition walls having inside some longitudinal profiles (3), in such a way that the longitudinal prifles (3) of the top are joined to the longitudinal profiles (3) of the base (1*b*) and vice versa by mans of the resistant ties (4). The ties (4) are positioned in accordance with the transversal or inclined planes of the container on the whole, and form a zig-zag lining, i.e., form a triangular structural framwork as is clearly seen in FIG. 1.

Figure 3:
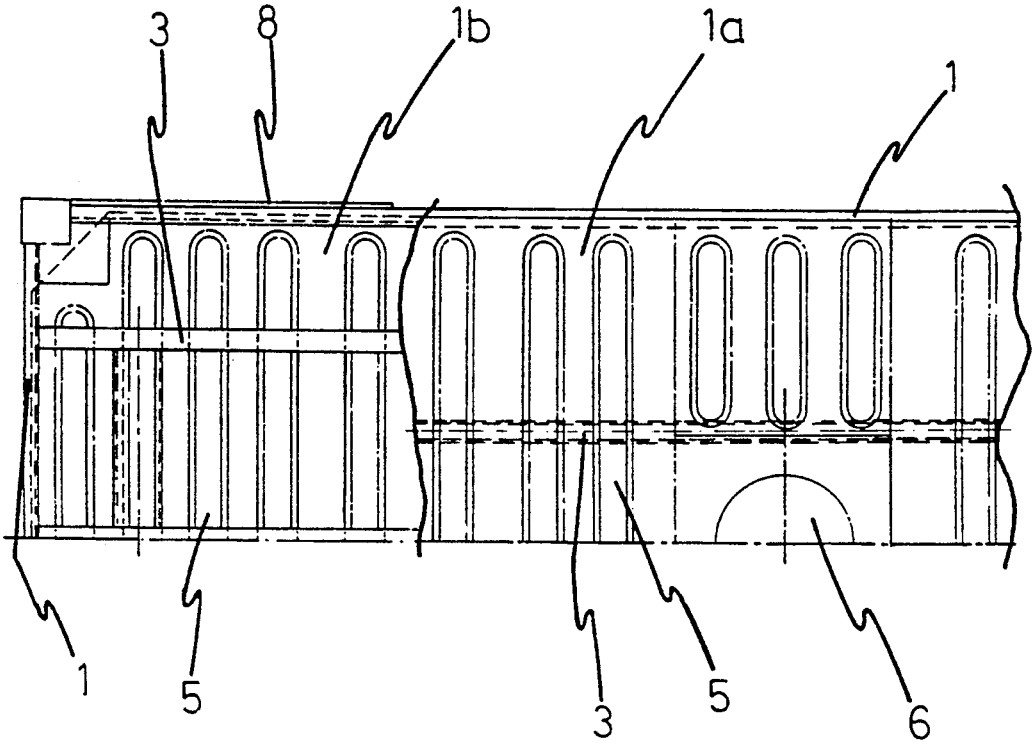
FIG. 3 shows a plan view of the container represented in the above figures, showing the top part with a part sectioned so that one can see the base part of the container.

In one embodiment, the partition walls (1) that make up the container are transversely corrugated, the wall forming the top (1*a*) as well as that forming the base (1*b*) are corrugated by means of over-elevations (5) or by means of elongated cavities with rounded edges, as is shown in FIG. 3. The corrugation is interrupted in the top as a result of the inlet (6) that the top has.

The top corners (7) of the container may have cross braces (8) that are connected to the respective point (9) of the corresponding base longitudinal edge (10) emerge, the cross braces constituting bending preventive reinforcements of the container when it is raised by the corners or when it rests on this ends.

The longitudinal profiles (3) constitute reinforcements to support a relative internal pressure, reinforcements that are complemented with the resistant ties (4) whose triangular or zin-zag framework prevents that the partition walls (1*a*) and (1*b*) from bulging outward as a result of the inner pressure of the container.

I claim:

1. Improvements in the construction of containers, of the type that includes a hollow body used to transport fluid, semi-fluid or granular products that may or may not be pressed, comprising six flat partition walls positioned according to the surfaces of a rectangular prims, each one of said partition walls being joined onto the contiguous partition walls by some rigid profiles, two of said partition walls defining a top and the base of the container, said top including at least two first longitudinal profiles, said base including at least two second longitudinal profiles, a plurality of resistant ties, each of said ties connected to one of said first longitudinal profiles and one of said second longitudinal prifles, each of said first and second longitudinal profiles having at least two of said ties connected thereto such that said at least two of said ties will form a triangle with one of said top and said base.

2. Improvements in the construction of containers, according to claim 1, further comprising an inlet in the top thereof, wherein al the partition walls that make up the container are corrugated transversely and said corrugation is in the top and in the base as of some over-elevations or some elongated cavities with rounded ends, said corrugation being interrupted only by the inlet.

3. Improvements in the construction of containers, according to claim 2, further comprising cross braces emerging from top corners of the containers and connected to a point of the corresponding bottom edge to define bending preventive reinforcements of the container.

4. Improvements in the construction of containers, according to claim 1, further comprising an inlet in the top thereof, wherein all the partition walls that make up the container are corrugated transversely and said corrugation is in the top and in the base as of some over-elevations or some elongated cavities with rounded ends, said corrugation being interrupted only by the inlet.

5. Improvements in the construction of containers, according to claim 4, further comprising cross braces emerging from top corners of the containers and connected to a point of the corresponding bottom edge to define bending preventive reinforcements of the container.

* * * * *